US012415640B2

(12) United States Patent
Gauger et al.

(10) Patent No.: US 12,415,640 B2
(45) Date of Patent: Sep. 16, 2025

(54) AUTOMATIC PACKAGING DISPENSING SYSTEM

(71) Applicant: A. J. ANTUNES & CO., Carol Stream, IL (US)

(72) Inventors: Steve Gauger, Crystal Lake, IL (US); Margaret Naden, West Dundee, IL (US); David Anchor, Union, IL (US); Chad Elliott, Frankfort, IL (US); Willilam Harrell, Garden Prairie, IL (US)

(73) Assignee: A. J. ANTUNES & CO., Carol Stream, IL (US)

( * ) Notice: Subject to any disclaimer, the term of this patent is extended or adjusted under 35 U.S.C. 154(b) by 945 days.

(21) Appl. No.: 16/817,361

(22) Filed: Mar. 12, 2020

(65) Prior Publication Data

US 2020/0317380 A1 Oct. 8, 2020

Related U.S. Application Data

(60) Provisional application No. 62/817,007, filed on Mar. 12, 2019.

(51) Int. Cl.
*B65B 41/06* (2006.01)
*B65B 57/02* (2006.01)

(52) U.S. Cl.
CPC ..... *B65B 41/06* (2013.01); *B65B 57/02* (2013.01)

(58) Field of Classification Search
None
See application file for complete search history.

(56) References Cited

U.S. PATENT DOCUMENTS 2,653,743 A * 9/1953 Stenger ..... B65B 43/44 271/99
2,880,995 A * 4/1959 Rimes ..... B65B 41/06 271/42
3,334,891 A * 8/1967 Clausen ..... B65H 7/12 271/30.1
2015/0087491 A1* 3/2015 Langen ..... B31B 50/262 493/162
2017/0348939 A1* 12/2017 Langen ..... B31B 50/26

FOREIGN PATENT DOCUMENTS

EP 3187441 A1 * 7/2017 ..... B65G 59/04
WO WO-2010061312 A2 * 6/2010 ..... B65B 13/14
WO WO-2011032565 A2 * 3/2011 ..... B43M 5/042

* cited by examiner

*Primary Examiner* — Tanzim Imam
(74) *Attorney, Agent, or Firm* — LAW OFFICES OF STEVEN W. WEINRIEB

(57) ABSTRACT

An automatic packaging dispensing system comprises a plurality of different packaging boxes disposed in vertical stacks upon a plurality of packaging box platforms, and a plurality of different wrapping paper packaging sheets disposed within trays housed within a housing. A vacuum pickup device is located at vacuum pickup station toward which a predeterminedly selected one of the plurality of different packaging boxes, or a predeterminedly selected one of the plurality of different wrapping paper packaging sheets, may be moved such that the vacuum pickup device may pick up the predeterminedly selected one of the different packaging boxes or wrapping paper packaging sheets and transfer the predeterminedly selected one of the different packaging boxes or wrapping paper packaging sheets to a downstream location.

19 Claims, 13 Drawing Sheets

AUTOMATIC PACKAGING DISPENSING SYSTEM

REFERENCE TO CORRESPONDING APPLICATION

This United States Non-Provisional patent application is a Non-Provisional Conversion of U.S. Provisional Patent Application No. 62/817,007 which was filed on Mar. 12, 2019, the priority benefits of which are hereby claimed.

FIELD OF THE INVENTION

The present invention relates generally to food service equipment, and more particularly to a new and improved automatic packaging dispensing system which is to be utilized in restaurants, particularly fast-food restaurants, in order to quickly and accurately prepare food products, such as, for example, conventional hamburger sandwiches which require two buns, or Big Mac® sandwiches which require three buns, or other food items which desire or require to have the food items to be placed within specific packaging boxes or wrapping paper packaging in accordance with specific patron orders.

BACKGROUND OF THE INVENTION

Conventionally, when preparing specific food orders, particularly in a fast-food restaurant, and more particularly, in connection with hamburgers, Big Macs®, Whoppers®, nachos, chicken nuggets, fish filets, or the like, food preparation personnel must, for example, conventionally utilize different types of packaging for the particular food items, whether such packaging may be, for example, a particular box or a particular wrapping paper packaging, or sometimes, both. Obviously, the conventional packaging of food items, within a particular packaging box or wrapping paper packaging, is somewhat tedious, cumbersome and time-consuming in that the food preparation personnel must select a particularly sized packaging box depending upon the food item to be placed in a packaging box, or to similarly select a particularly sized wrapping paper packaging. This process becomes particularly tedious when different orders, ordered in a serial manner by different patrons at a point-of-sale (POS) location, requires different packaging boxes or different wrapping paper packaging which are to be correlated with or matched to the different serially placed orders.

In other words, a first order may be for a regular hamburger which requires a first type of wrapping paper packaging, a second order may be for a Big Mac® which requires a particular packaging box, a third order may be for a fish filet which requires a second type of packaging box, a fourth order may be for chicken nuggets which require a third type of packaging box, and a fifth order may be for a salad which requires a fourth type of packaging box. It can therefore be appreciated that different types of wrapping paper packaging or different types of packaging boxes will be required at unpredictable times in accordance with the different orders places by the different patrons placed at the point-of-sale (POS) location. Such differences in orders, together with the constant requirement for speed in providing the correct food orders to the patrons can also impose a predetermined amount of tension upon food preparation personnel. It can therefore be readily appreciated still further that such food preparation procedures are very inefficient, time consuming, and labor intensive, particularly for fast-food restaurants wherein quick or rapid cooking or toasting food preparation times are required or desirable in order to produce the finalized food items within relatively short service times which effectively define one of the more important and attractive features or characteristics of fast-food establishments.

A need therefore exists in the art for a new and improved piece of food service equipment. An additional need exists in the art for a new and improved piece of food service equipment which is adapted to prepare specific food items. A still additional need exists in the art for a new and improved piece of food service equipment which is adapted to prepare specific food items, such as, for example, hamburgers, Big Macs®, Whoppers®, nachos, fish filets, chicken nuggets, or the like. A yet additional need exists in the art for a new and improved piece of food service equipment which can be utilized in various different food establishments. A still yet additional need exists in the art for a new and improved piece of food service equipment which can be utilized in various different food establishments, such as, for example, fast food restaurants. A further need exists in the art for a new and improved piece of food service equipment which can be utilized in various different food establishments, such as, for example, fast food restaurants, wherein quick turnaround time for preparing food item orders is a highly sought-after feature or characteristic. A still further need exists in the art for a new and piece of improved food service equipment which can be utilized in various different food establishments, such as, for example, fast food restaurants, wherein the equipment is very efficient in connection with the preparation of specific food items ordered by patrons at the point-of-sale (POS) location. A yet further need exists in the art for a new and improved piece of food service equipment which can be utilized in various different food establishments, such as, for example, fast food restaurants, wherein the equipment is very efficient in connection with the preparation of the food items or products, and can be operated by means of a minimum number of food preparation personnel.

A still yet further need exists in the art for a new and improved piece of food service equipment which can be utilized in various different food establishments, such as, for example, fast food restaurants, wherein the equipment is very efficient in connection with the preparation of the food items or products, can be easily operated by means of a minimum number of food preparation personnel, and can be utilized to prepare numerous food items in an automatic, serial manner as opposed to the food items being singly prepared in a one-by-one fashion. A yet still further need exists in the art for a new and improved piece of food service equipment which can be utilized in various different food establishments, such as, for example, fast food restaurants, wherein numerous types of packaging can effectively be pre-loaded into the equipment, particularly during lull or relatively slow business hours or times, such that the plurality of food items will then be able to be substantially immediately prepared as orders are inputted into the system for patrons at the point-of-sale (POS) location as opposed to being constrained to being processed in a single or one-by-one fashion. An additional need exists in the art for a new and improved piece of food service equipment which can be utilized in various different food establishments, such as, for example, fast food restaurants, wherein numerous types of packaging can effectively be pre-loaded into the equipment, particularly during lull or relatively slow business hours or times, and then dispensed automatically such that the plurality of food items will then be able to be substantially immediately prepared in accordance with orders that are inputted into the system for patrons at the point-of-sale (POS) location. A still additional need exists in the art for a new and improved piece of food service equipment which can be utilized in various different food establishments, such as, for example, fast food restaurants, wherein numerous types of packaging can effectively be pre-loaded into the equipment, particularly during lull or relatively slow business hours or times, and then dispensed automatically such that food preparation personnel are not required to select, nor are involved with the selection of, the particular packaging for a particular food item whereby the plurality of food items will then be able to be substantially immediately prepared as orders are inputted into the system for patrons at the point-of-sale (POS) location.

OVERALL OBJECTIVES OF THE PRESENT INVENTION

Therefore, a primary objective of the present invention is to therefore provide a new and improved piece of food service equipment. An additional objective of the present invention is to provide a new and improved piece of food service equipment which is adapted to prepare specific food items. A still additional objective of the present invention is to provide a new and improved piece of food service equipment which is adapted to prepare specific food items, such as, for example, hamburgers, Big Macs®, Whoppers®, nachos, fish filets, chicken nuggets, or the like. A yet additional objective of the present invention is to provide a new and improved piece of food service equipment which can be utilized in various different food establishments. A still yet additional objective of the present invention is to provide a new and improved piece of food service equipment which can be utilized in various different food establishments, such as, for example, fast food restaurants. A further objective of the present invention is to provide a new and improved piece of food service equipment which can be utilized in various different food establishments, such as, for example, fast food restaurants, wherein quick turnaround time for preparing food item orders is a highly sought-after feature or characteristic. A still further objective of the present invention is to provide a new and piece of improved food service equipment which can be utilized in various different food establishments, such as, for example, fast food restaurants, wherein the equipment is very efficient in connection with the preparation of specific food items ordered by patrons at the point-of-sale (POS) location. A yet further objective of the present invention is to provide or a new and improved piece of food service equipment which can be utilized in various different food establishments, such as, for example, fast food restaurants, wherein the equipment is very efficient in connection with the preparation of the food items or products, and can be operated by means of a minimum number of food preparation personnel.

A still yet further objective of the present invention is to provide a new and improved piece of food service equipment which can be utilized in various different food establishments, such as, for example, fast food restaurants, wherein the equipment is very efficient in connection with the preparation of the food items or products, can be easily operated by means of a minimum number of food preparation personnel, and can be utilized to prepare numerous food items in an automatic, serial manner as opposed to the food items being singly prepared in a one-by-one fashion. A yet still further objective of the present invention is to provide a new and improved piece of food service equipment which can be utilized in various different food establishments, such as, for example, fast food restaurants, wherein numerous types of packaging can effectively be pre-loaded into the equipment, particularly during lull or relatively slow business hours or times, such that the plurality of food items will then be able to be substantially immediately prepared as orders are inputted into the system for patrons at the point-of-sale (POS) location as opposed to being constrained to being processed in a single or one-by-one fashion. An additional objective of the present invention is to provide a new and improved piece of food service equipment which can be utilized in various different food establishments, such as, for example, fast food restaurants, wherein numerous types of packaging can effectively be pre-loaded into the equipment, particularly during lull or relatively slow business hours or times, and then dispensed automatically such that the plurality of food items will then be able to be substantially immediately prepared as orders are inputted into the system for patrons at the point-of-sale (POS) location. A still additional objective of the present invention is to provide for a new and improved piece of food service equipment which can be utilized in various different food establishments, such as, for example, fast food restaurants, wherein numerous types of packaging can effectively be pre-loaded into the equipment, particularly during lull or relatively slow business hours or times, and then dispensed automatically such that food preparation personnel are not required to select, nor are involved with the selection of, the particular packaging for a particular food item whereby the plurality of food items will then be able to be substantially immediately prepared as orders are inputted into the system for patrons at the point-of-sale (POS) location.

SUMMARY OF THE INVENTION

The foregoing and other objectives of the present invention are achieved in accordance with the principles and teachings of the present invention through the provision of a new and improved automatic food item packaging dispensing system wherein the system is adapted to dispense both packaging boxes and wrapping paper packaging. The packaging boxes and wrapping paper packaging are located at particular locations along a food preparation line where a vacuum suction cup gripping assembly is utilized to pick up an uppermost one of a plurality of different packaging boxes units, or an uppermost one of a plurality of different wrapping paper packaging units, and to deposit the same onto a conveyor belt so that the packaging boxes or wrapping paper packaging may be moved to the next food preparation station of the food preparation line. The packaging box sub-system comprises a plurality of different packaging boxes that are disposed within different packaging box assemblies which are mounted upon a mounting plate which is moved laterally by means of a linear belt drive so as to selectively move a particular one of the packaging box assemblies to a particular location at which the vacuum suction cups can pick up the uppermost one of the packaging boxes disposed within that particular packaging box assembly.

In turn, each packaging box assembly comprises a box support platform, a peripheral framework for effectively enclosing the boxes upon the platform, a pair of vertically oriented guide rods which serve to retain the packaging boxes in both forward/backward and lateral directions within the peripheral framework, a plurality of inwardly extending flexible fingers to effectively maintain the supply of boxes upon the platform so that together there is defined a magazine supply of boxes, and a packaging box sensor which is aligned with an aperture defined within the box support platform so as to detect whether any boxes remain upon the platform or that the supply of boxes has been depleted. Constant force springs are also operatively connected to the box support platform so as to always bias the box support platform in a vertically upward direction such that the uppermost packaging box is always located at the same location relative to the vacuum suction cups so as to enable the vacuum suction cups to pick up the uppermost packaging box and transfer it to one of the food preparation line conveyors. As the vacuum suction cups remove the uppermost box, the flexible fingers will effectively be moved out of the way so as to permit the uppermost box to be extracted from the magazine supply of boxes but will immediately return to their original unflexed position so as to prevent a second box from being removed from the magazine along with the uppermost box.

The wrapping paper packaging sub-system comprises a plurality of trays, each of which holds a predetermined number of wrapping paper packaging sheets, wherein the plurality of trays are disposed within a housing which is vertically movable along vertically oriented ball screw actuator driven by means of a suitable motor, wherein the vertically oriented ball screw actuator is also fixedly mounted upon a vertically oriented mounting platform or wall. Each tray is also slidable upon horizontally oriented ball-bearing slides or tracks, which are similar to the mounting of drawers within desks or other furniture, so that the trays can be easily and readily moved from their normal positions internally within the tray housing to an external position relative to the tray housing when packaging sheets within a particular tray needs to be accessed by means of the vacuum suction cups. Each forward end of each wrapping paper tray is provided with a horizontally oriented finger, and a horizontally oriented tray extension cylinder is mounted upon the vertically oriented mounting platform or wall so as to encounter the finger of a particular wrapping paper tray and thereby cause the tray to be moved out from the interior of the paper tray housing to an external position at which the vacuum suction cups can engage the uppermost wrapping paper sheet within that wrapping paper tray and then transfer that wrapping paper sheet to the food preparation line conveyor.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

Figure 4:
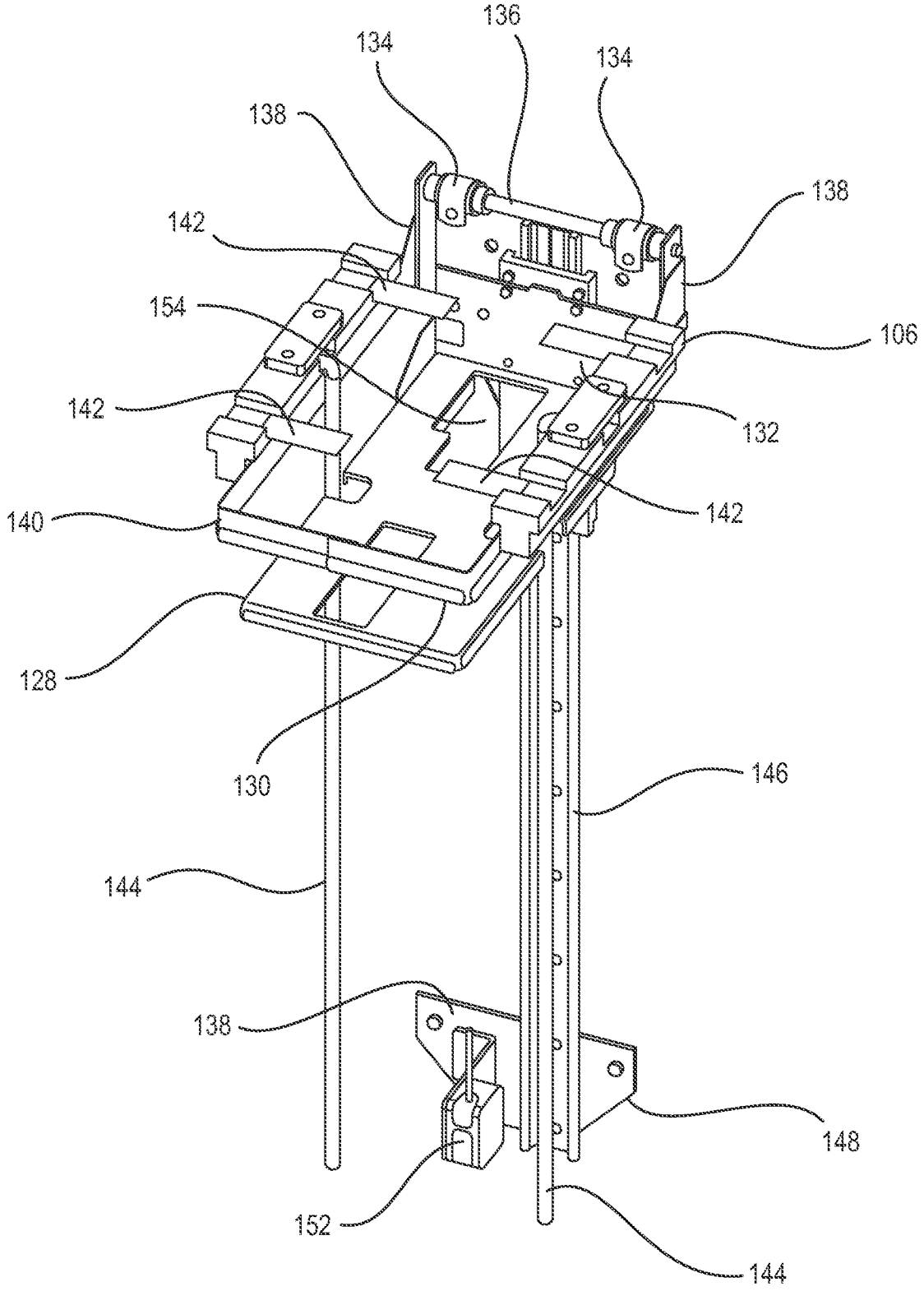
FIG. 4 is a perspective view illustrating the various components comprising one of the packaging box assemblies, including the vertically oriented guide rods which will engage side portions of the packaging boxes so as to maintain the packaging boxes stationary within the packaging box assemblies both in longitudinal or forward/backward as well as lateral or side-to-side modes.
Figure 5:
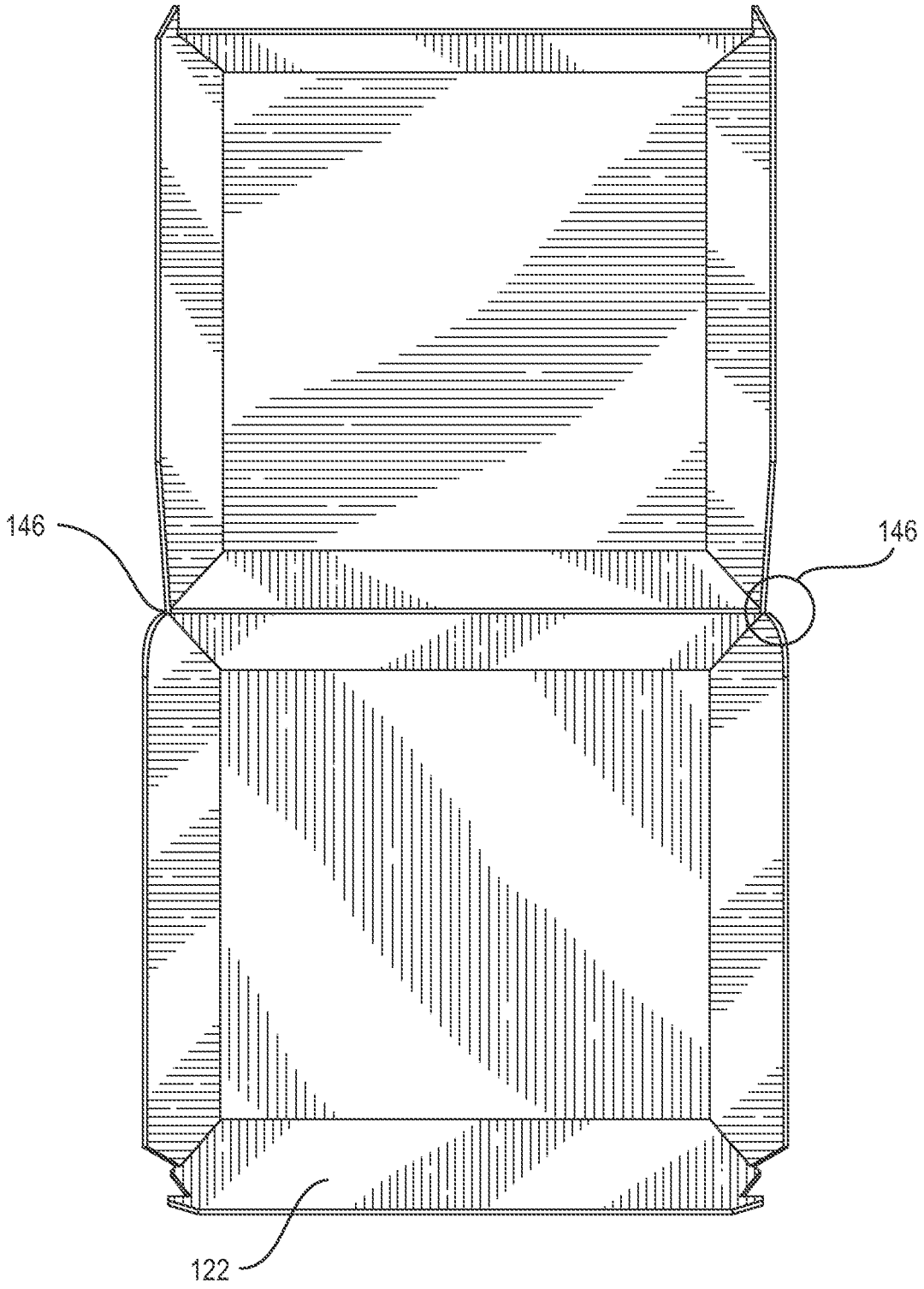
Figure 6:
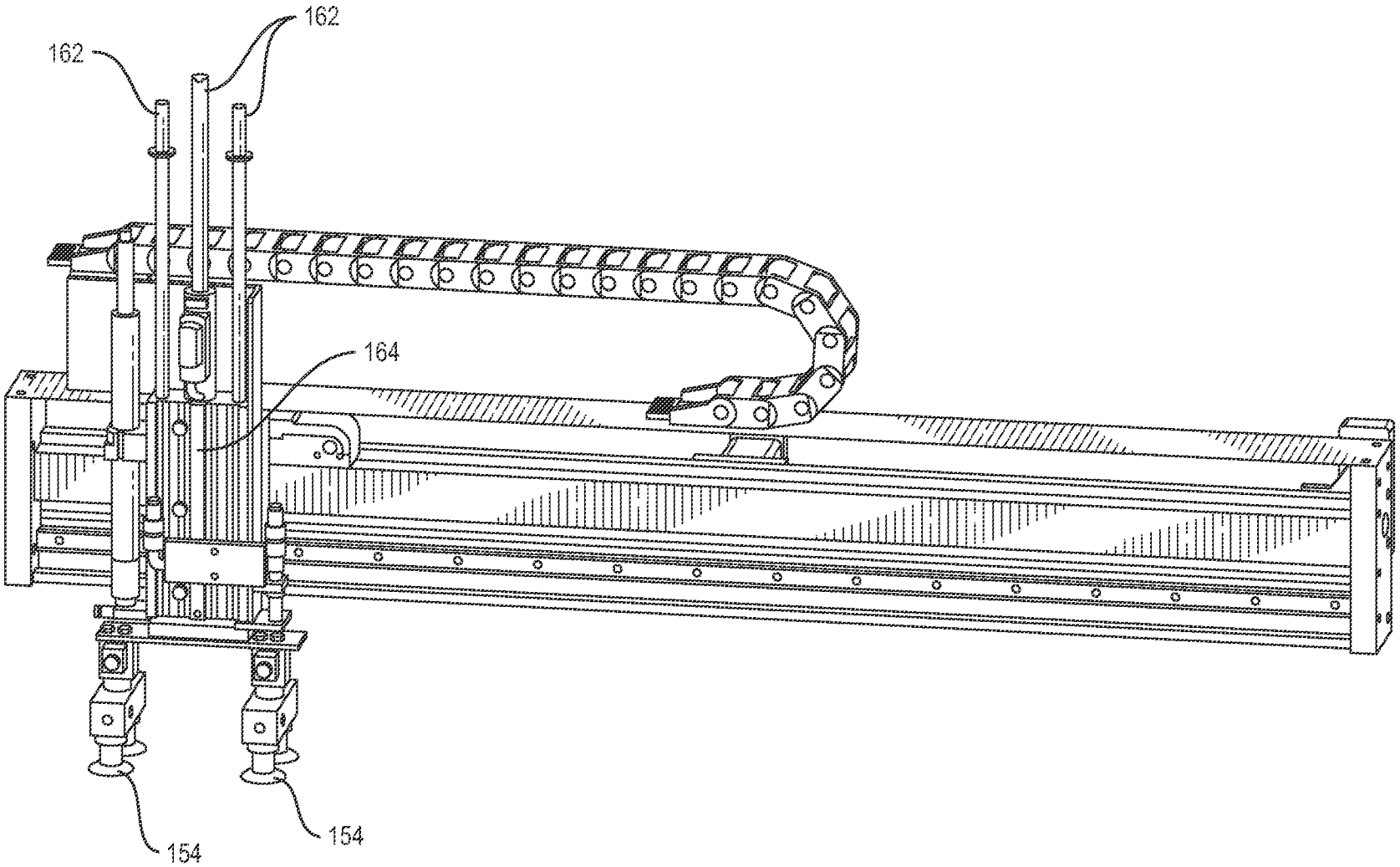
Figure 7:
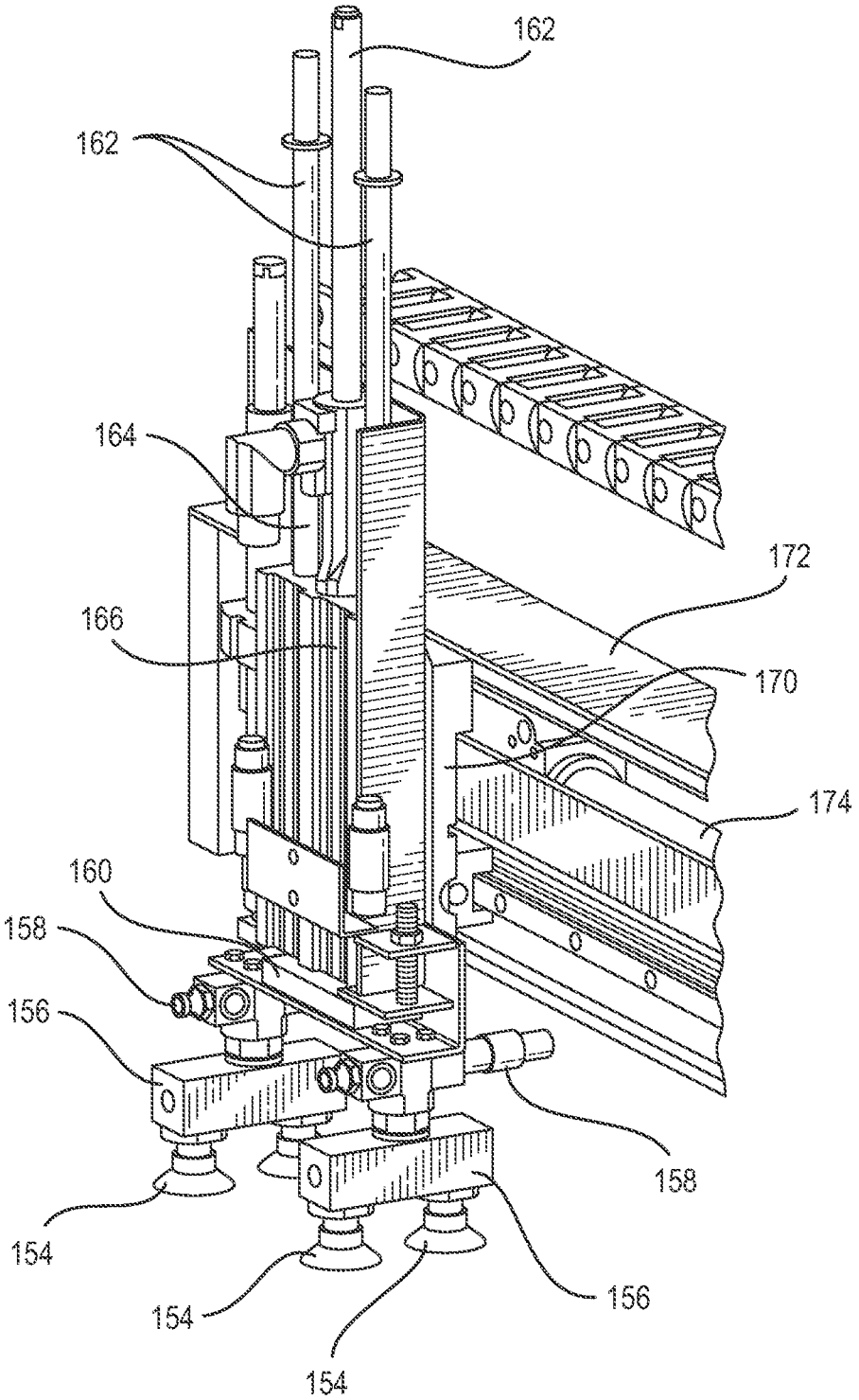
Figure 8:
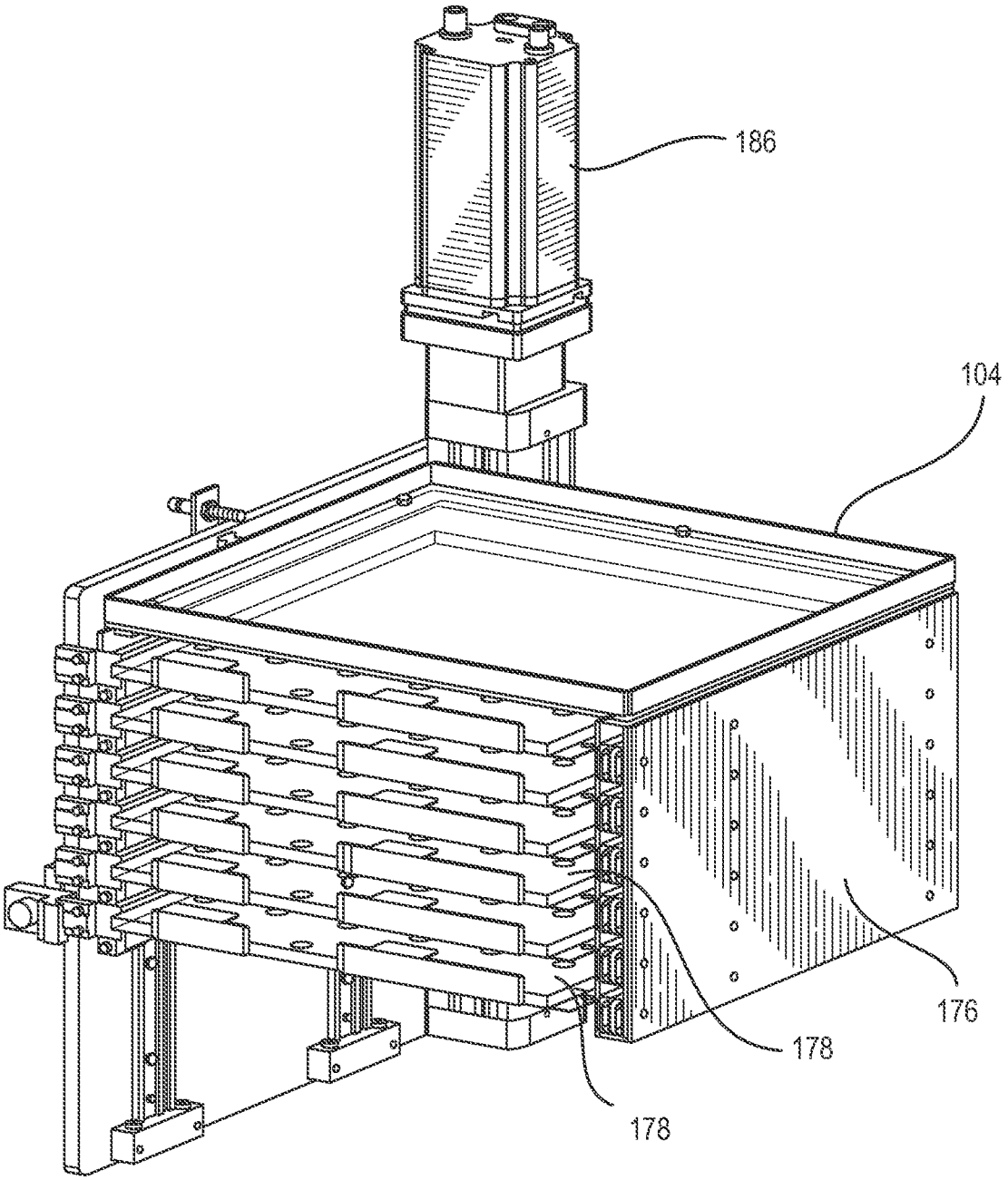
Figure 9:
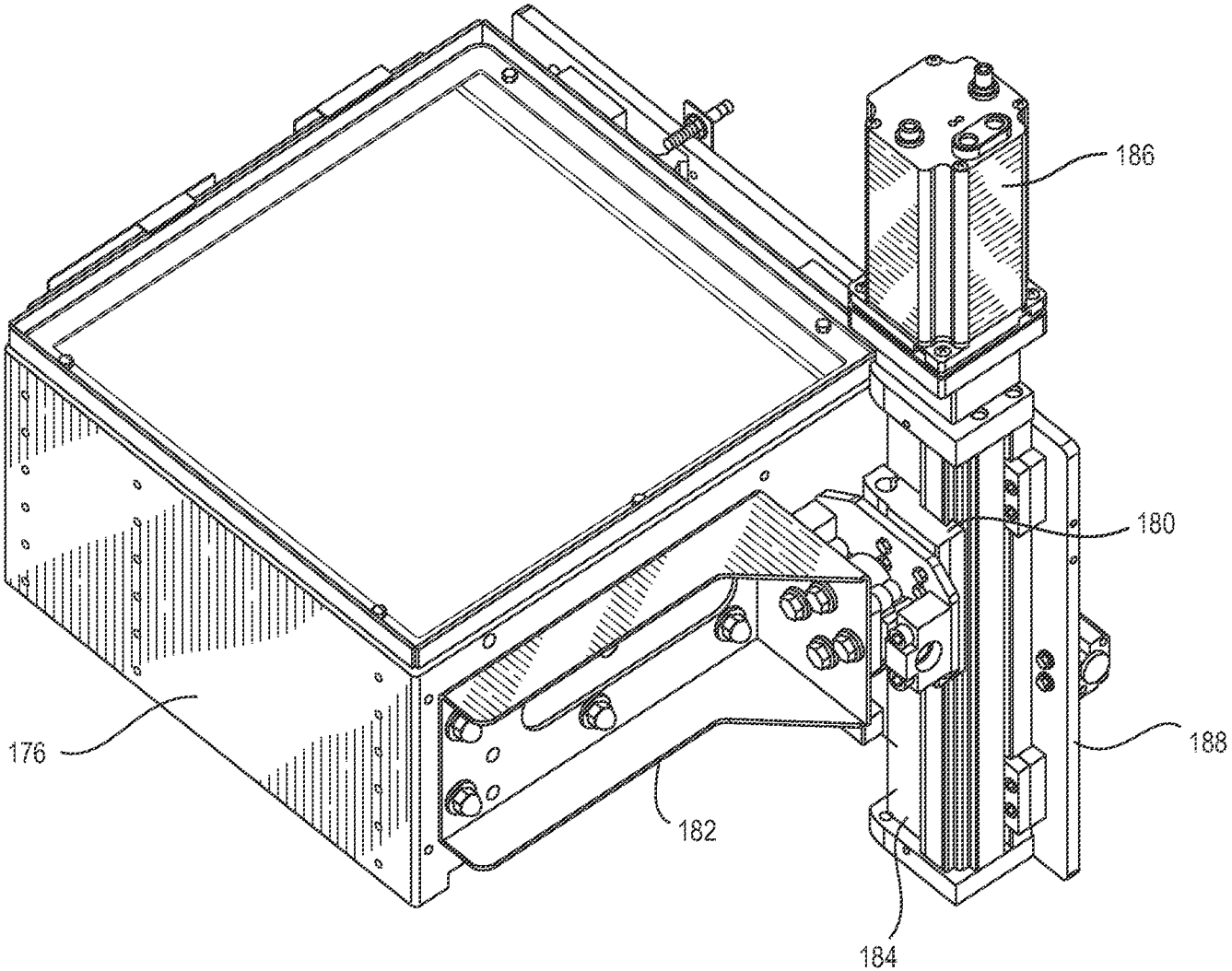
Figure 10:
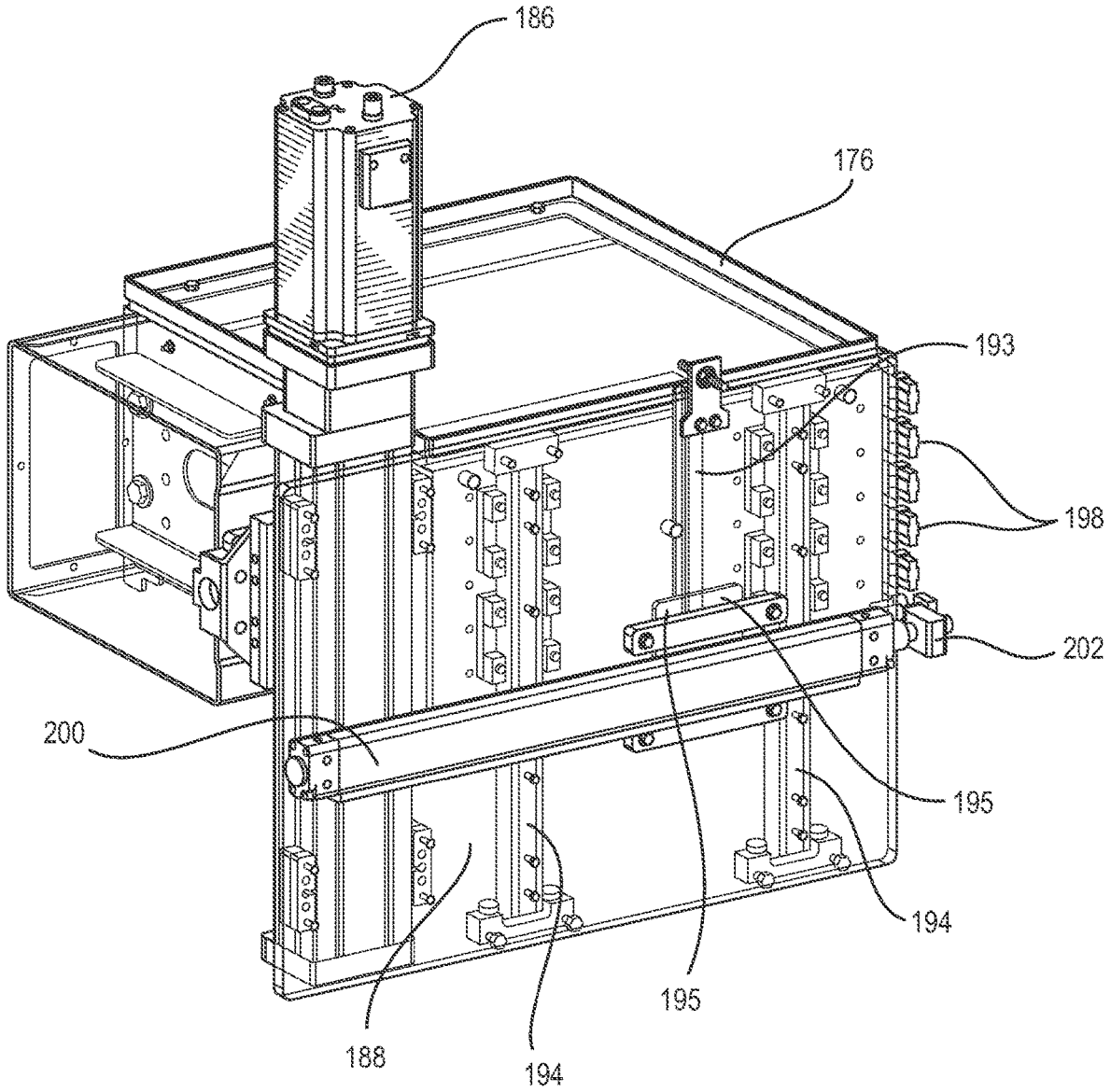
Figure 11:
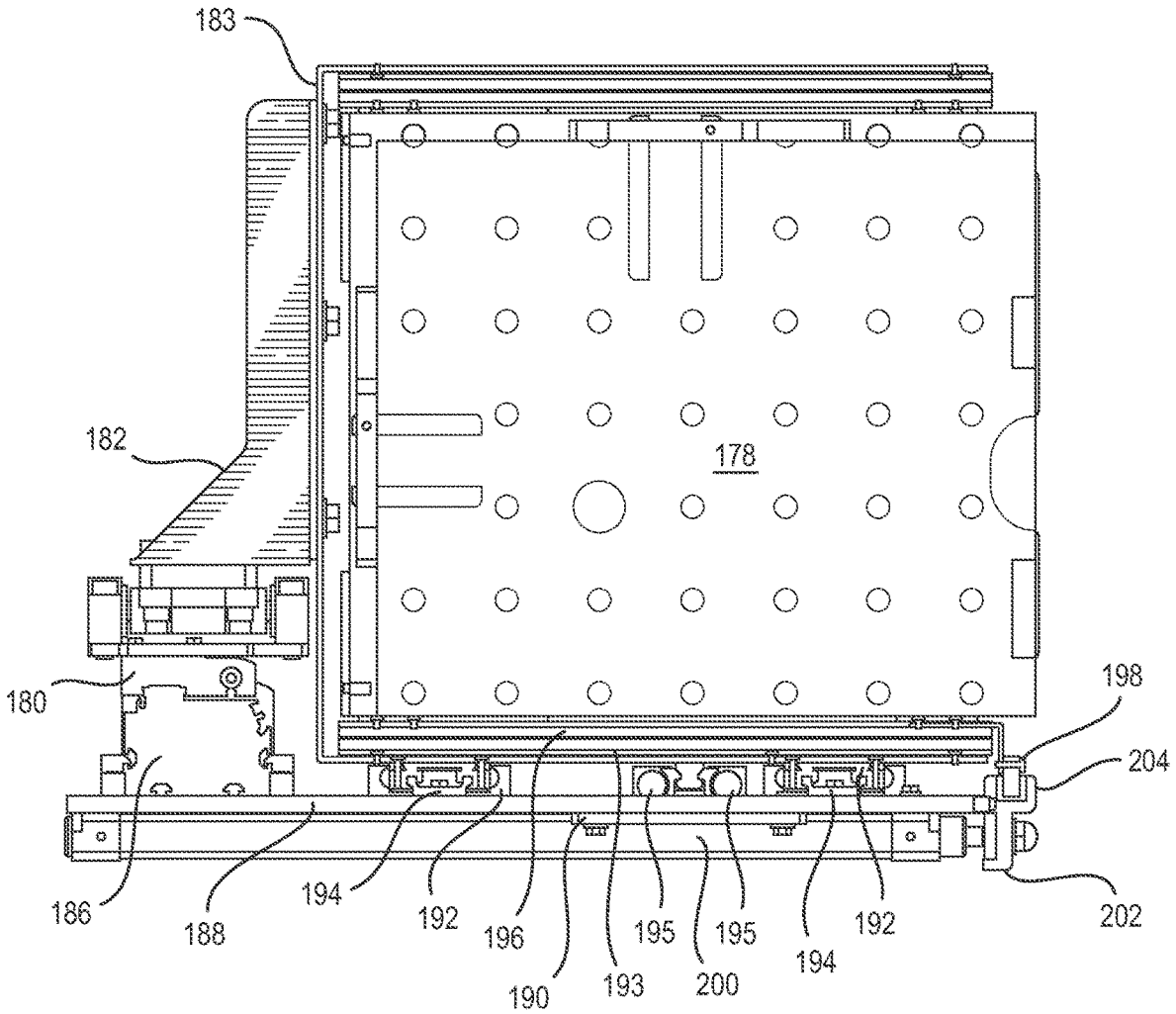
Figure 12:
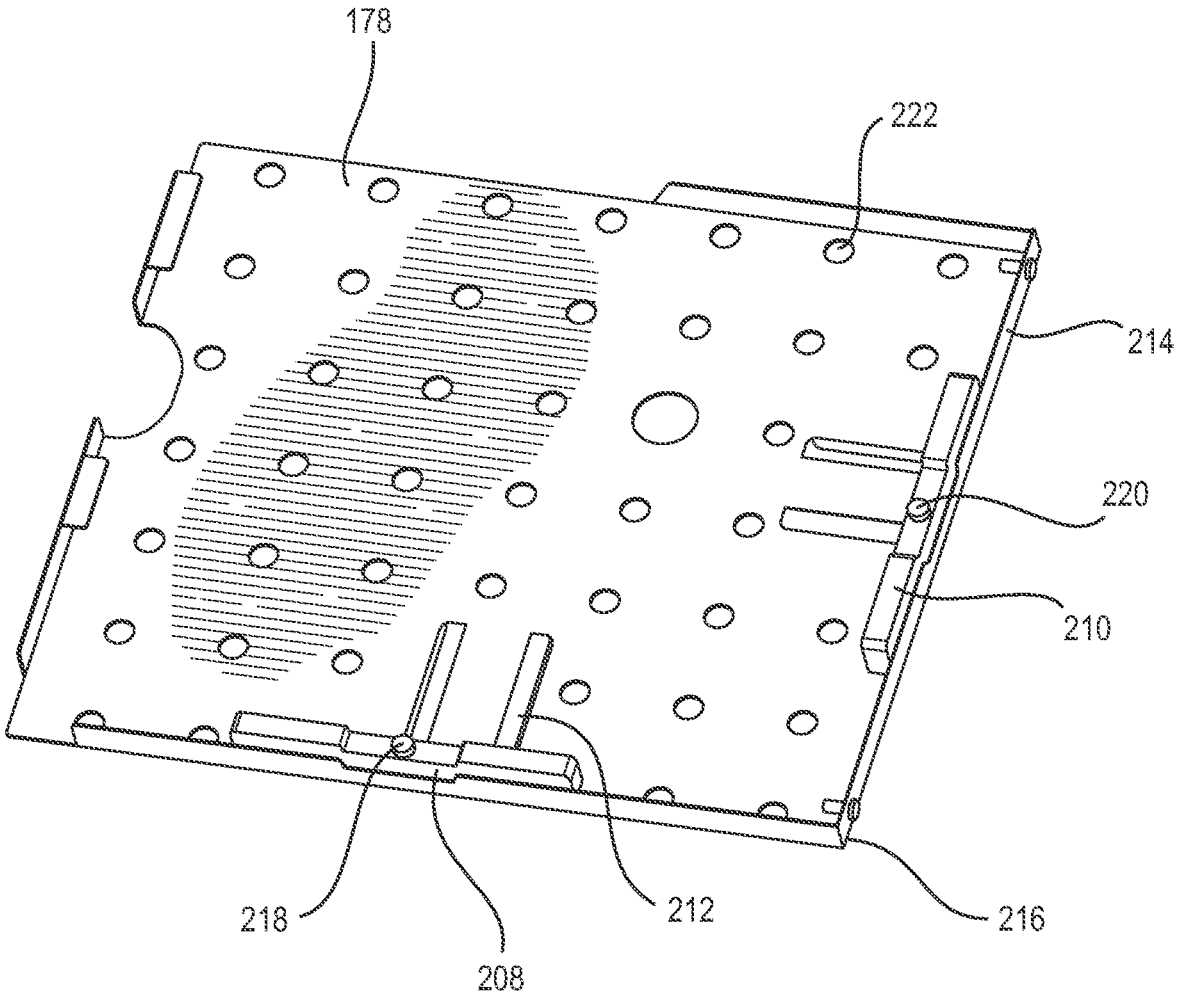

FIG. **4*a*** is an enlarged perspective view of the upper ends of the guide rods as mounted within the peripheral framework of the packaging box assemblies so as to permit the guide rods to be adjusted laterally with respect to each other so as to be capable of accommodating different packaging boxes having different width dimensions;

FIG. 5 is a plan view of a typical packaging box showing the corner interconnections between the upper and lower half sections of the packaging box which is where the vertically oriented guide rods of FIG. 4 will be disposed so as to properly engage the packaging boxes;

FIG. 6 is a side perspective view of the vacuum suction cup gripping assembly illustrating the vertically oriented servo drive motor for moving the plurality of suction cups vertically upwardly and downwardly;

FIG. 7 is an enlarged perspective view of the vacuum suction cup gripping assembly as illustrated within FIG. 6 illustrating the mounting of the vertically oriented servo drive motor upon a mounting plate which is fixedly connected to a horizontally oriented servo drive motor which is utilized for moving the vacuum suction cup gripping assembly in forward and backward modes so as to properly position the vacuum suction cup gripping assembly over a packaging box or a wrapping paper packaging sheet disposed within one of the trays of the wrapping paper packaging sub-system;

FIG. 8 is a perspective view of the wrapping paper packaging sub-system illustrating the plurality of horizontally oriented, vertically spaced paper trays mounted within a wrapping paper packaging housing and respectively containing a plurality of different wrapping paper packaging sheets;

FIG. 9 is an enlarged front, right side, perspective view illustrating how the wrapping paper packaging housing is fixedly connected to a vertically oriented actuator whereby actuation of the actuator, the wrapping paper packaging housing is moved upwardly and downwardly;

FIG. 10 is rear view of the wrapping paper packaging sub-system illustrating the mounting of the wrapping paper packaging housing upon vertically oriented guide rods fixedly secured to a rear wall of the sub-system, as well as the tray extension cylinder/actuator for moving a selected one of the plurality of wrapping paper trays outwardly from the wrapping paper packaging housing or for returning the selected tray back into the wrapping paper packaging housing once a particular wrapping paper packaging sheet has been removed from the selected tray;

FIG. 11 is a top plan view of one of the wrapping paper packaging trays illustrating additional details as to how the wrapping paper packaging trays are mounted upon the vertically oriented guide rails for vertical movement; and FIG. 12 is a perspective view of one of the wrapping paper packaging trays illustrating adjustable positioning guides disposed within the wrapping paper packaging tray such that any one of the plurality of wrapping paper packaging trays can accommodate any particularly sized wrapping paper packaging sheets, as well as an aperture which is formed within a relatively central portion of the wrapping paper packaging tray for cooperating with a sensor to indicate that the supply of wrapping paper packaging sheets has been depleted.

DETAILED DESCRIPTION OF THE PREFERRED EMBODIMENT

With reference now being made to FIGS. 1-5, the new and improved automatic packaging dispensing system of the present invention is disclosed and is generally indicated by the reference character 100. More particularly, it is seen that the system 100 is adapted to dispense both packaging boxes and wrapping paper packaging and therefore comprises a packaging box sub-system 102 and a wrapping paper packaging sub-system 104. The packaging box sub-system 102 comprises a plurality of different types or sizes of packaging boxes that are disposed within different packaging box assemblies 106 which are fixedly mounted at their upper end portions upon a mounting plate 108 which is operatively connected to a linear belt drive 110 by means of a mounting bracket 112 disposed atop a linear slide block 114 which is connected to the linear belt drive 110. A reversible motor 116 is operatively connected to the linear belt drive 110 so that when the reversible motor 116 is actuated in a first mode for a predetermined amount of time, the linear belt drive 110 will move the mounting plate 108 and the plurality of packaging box assemblies 106 mounted thereon a predetermined distance in a first direction, whereas, when the reversible motor 116 is actuated in a second mode for a predetermined amount of time, the linear belt drive 110 will move the mounting plate 108 and the plurality of packaging box assemblies 106 mounted thereon a predetermined distance in a second opposite direction.

Figure 1:
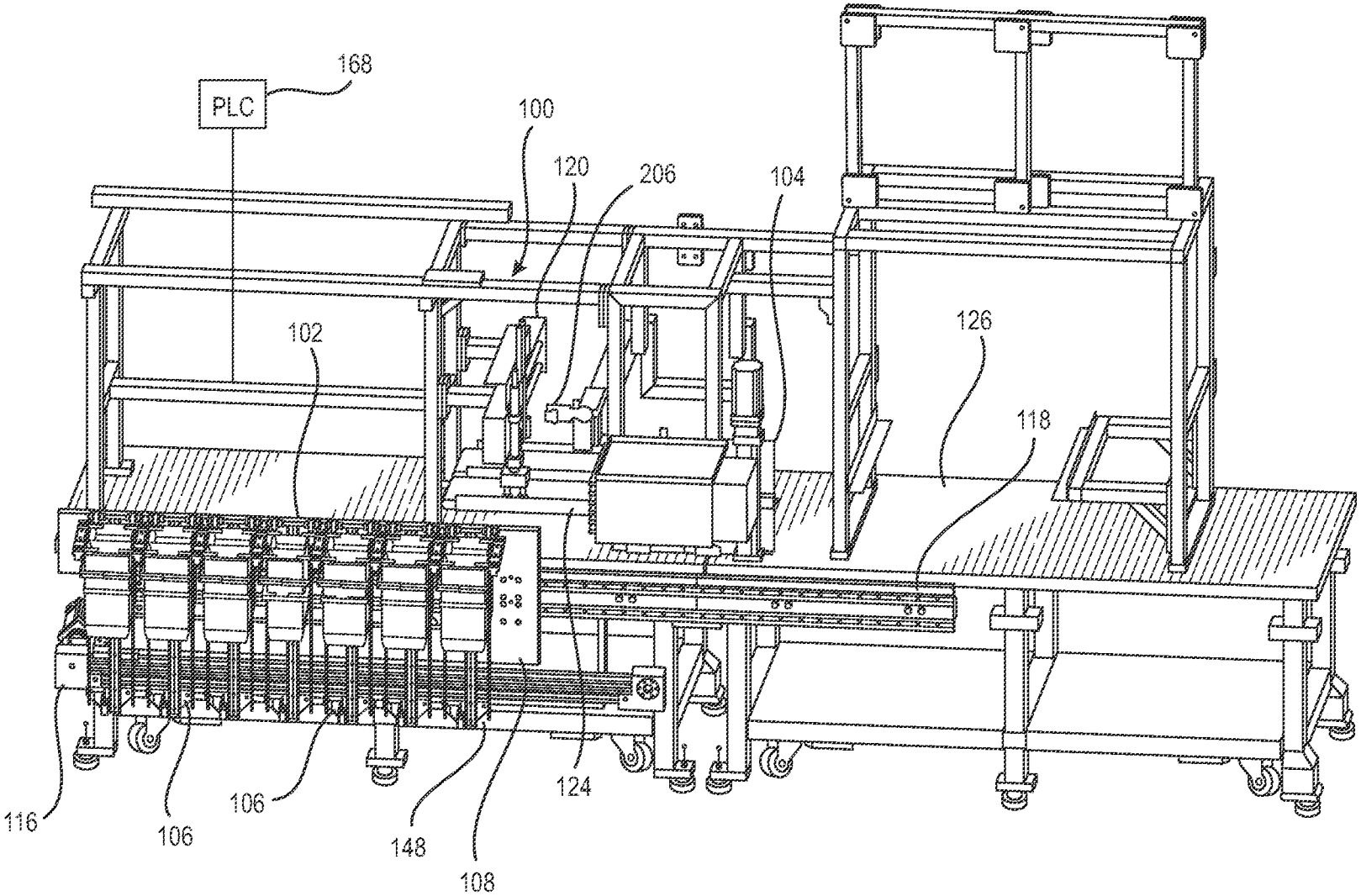
FIG. 1 is a front, top perspective view showing the overall automatic packaging dispensing system constructed in accordance with the principles and teachings of the present invention.
Figure 2:
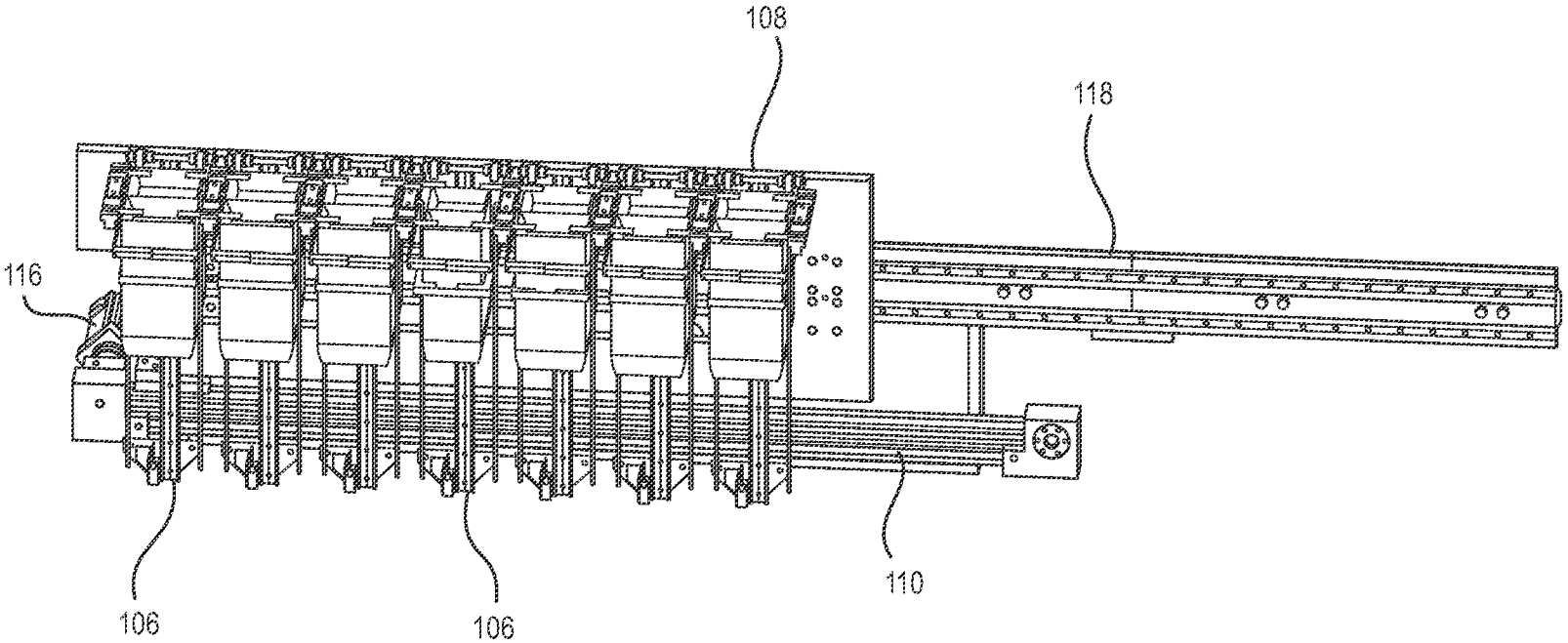
FIG. 2 is a front perspective view showing the packaging box sub-system comprising the plurality of packaging box assemblies which are fixedly secured upon a mounting plate which, in turn, is fixedly secured to a linear belt drive such that the plurality of packaging box assemblies can be moved transversely upon guide rails in order to properly position one of the packaging box assemblies beneath the vacuum suction cup gripping system.
Figure 3:
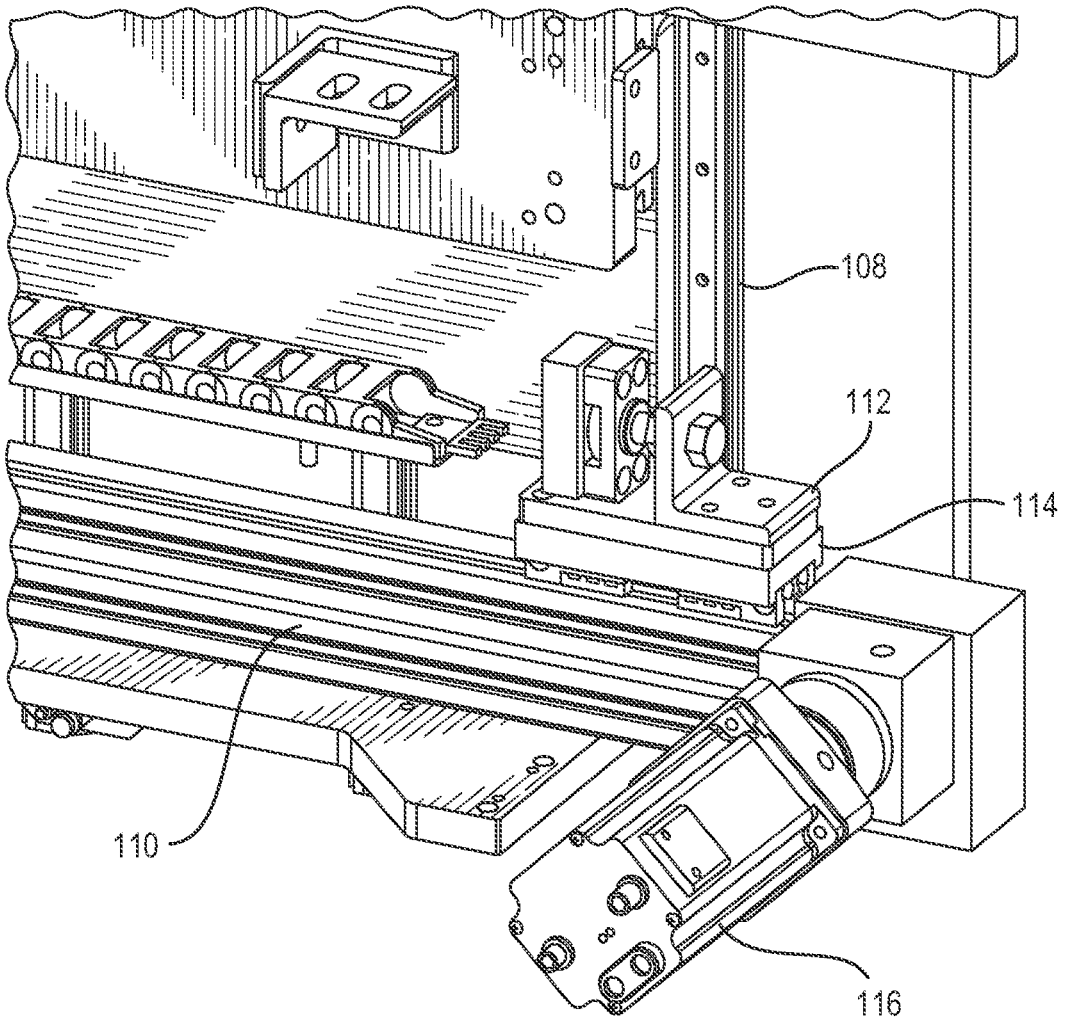
FIG. 3 is a rear perspective view of the mounting plate of FIG. 2 illustrating how the mounting plate is fixedly connected to the motor-driven linear belt drive.

The mounting plate 108 undergoes its lateral, reciprocating movements as a result of being movably attached to, and supported upon, a horizontally oriented guide rail 118 as can be seen in FIGS. 1 and 2. In this manner, any one of the plurality of packaging box assemblies 106 can be moved so as to be properly positioned relative to, and beneath, a vacuum suction cup pickup and transfer assembly 120, which can be seen in FIG. 1 and which will be more fully discussed hereinafter, such that the vacuum suction cup pickup and transfer assembly 120 can remove the uppermost packaging box, one exemplary box 122 being disclosed within FIG. 5, disposed within the particular packaging box assembly 106 and thereby transfer the packaging box 122 to a food preparation line conveyor 124, as seen in FIG. 1, such that the particular packaging box may be moved to the next food preparation station of a food preparation line 126.

With reference now being made to FIG. 4, one of the packaging box assemblies 106 will be described. More particularly, it is seen that each packaging box assembly 106 comprises a box support platform 128 upon which a plurality of a particular kind or type of packaging boxes 122 are to be stacked so as to effectively form a packaging box magazine from which the uppermost packaging box 122 will be removed by means of the vacuum suction cup assembly 120. The box support platform 128 actually comprises a horizontally oriented component 130, upon which the stack of packaging boxes 122 are actually disposed and supported, and an upstanding bracket 132 to which a pair of laterally spaced constant force springs 134 are adapted to be attached although the springs 134 are not shown attached in FIG. 4. The springs 134 are mounted upon a horizontal spindle 136, the ends of which are mounted within laterally spaced end brackets 138. The end brackets 138,138, in turn, are connected to a peripheral framework 140 which is mounted upon the mounting plate 108 and to which are attached a plurality, for example, four, leaf-spring type fingers 142, as well as a pair of vertically oriented packaging box guide rods 144 which depend vertically downwardly from opposite sides of the peripheral framework 140.

Figure 4A:
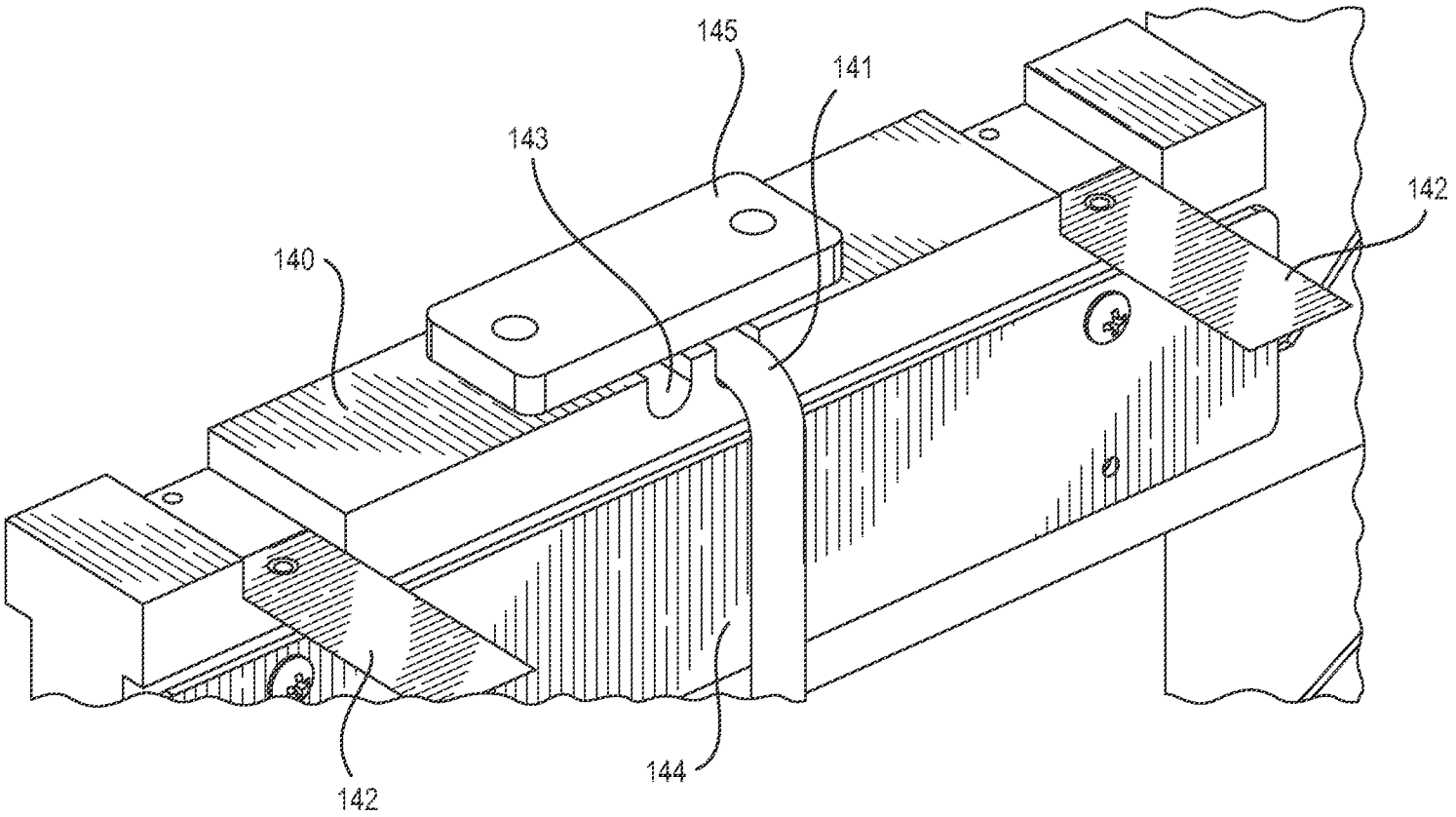

The peripheral framework 140 and the vertical guide rods 144 are adapted to maintain the stack of packaging boxes 122 upon the stacking platform component 130, with the vertical guide rods 144 engaging corner regions 146 of the packaging boxes where are effectively defined between the upper or cover portion of the packaging box 122 and the bottom portion of the packaging box 122. The disposition of the vertical guide rods 144 within the corner regions 146 of the packaging boxes 122 effectively prevents the plurality of packaging boxes 122 from moving forwardly and backwardly as well as laterally from side to side. Furthermore, with reference being additionally made to FIG. 4*a*, it is seen that the upper end portions 141 of the vertical guide rods 144 are bent at an angle of 90° and are seated within slots 143 defined within the peripheral framework 140. Accordingly, the upper end portions 141 of the pair of vertical guide rods 144 may be moved within the slots 143 and relative to each other such that the distance between the pair of vertical guide rods 144 is rendered adjustable. In this manner, different packaging boxes 122, having different width dimensions, can be housed or accommodated within the packaging box assembly 106. It is additionally noted that mounting plates 145 are fixedly secured atop the peripheral framework 140 so as to securely fix the bent end portions 141 of the vertical rods 144 within the slots 143 of the peripheral framework so that, in turn, the pair of vertical rods 144 will remain at their relative desired spacing so as to house or accommodate differently sized packaging boxes 122.

Accordingly, it can be appreciated that as a stack of packaging boxes 122 are mounted upon the horizontal component 130 of the box support platform 128, the box support platform 128 will be moved downwardly and the constant force springs 134, when attached to the rear upstanding wall component 132 of the box support platform 128, will be extended such that the constant force springs 134 will continuously tend to move the box support platform 128 back toward its uppermost position so as to continuously move the box support platform 128 incrementally upwardly as the uppermost packaging box 122 is removed from the box support platform 128 by means of the vacuum suction cup assembly 120. The box support platform 128 moves vertically downwardly and upwardly along a vertically oriented guide rail 146 which is fixedly secured at its lower end to a mounting bracket 148. The plurality of fingers 142 extending into the central part of the peripheral framework 140 supply a sufficient retaining force to the stack of packaging boxes 122 disposed upon the horizontal component 130 of the packaging box platform 128, however, when the uppermost packaging box 122 is removed by means of the vacuum suction cup assembly 120, the plurality of fingers will flex upwardly, permitting the uppermost packaging box 122 to be withdrawn from the stack of packaging boxes 122 disposed upon the horizontal component 130 of the packaging box platform 128, and will effectively slide along the external surface portions of the uppermost packaging box 122 being withdrawn by means of the vacuum suction cup assembly 130 until the fingers 142 snap back to their original positions, thereby preventing any further packaging boxes 122 from being removed from the packaging box assembly 106. It is lastly noted that the packaging box assembly 106 also includes a packaging box sensor 152 which is adapted to be coaxially aligned with an aperture 154 defined within the horizontal component 130 of the packaging box platform 128. In this manner, in a manner similar to a photocopying machine warning the user that the supply of paper in the paper tray has been depleted, the sensor 152 will sense when the last packaging box 122 has been removed from the packaging box assembly 106 whereby the supply of packaging boxes 122 needs to be replenished.

Continuing further, and with particular reference being made to FIGS. 6 and 7, the vacuum suction cup pickup and transfer system 120 will now be described. A pair of suction cups 154 are fixedly attached to the bottom surfaces of a pair of vacuum manifolds 156 so that the system comprises four suction cups 154. Each one of the vacuum manifolds 156 is fluidically connected to a vacuum generator 158, and the vacuum generators 158,158 are fixedly mounted upon a horizontally oriented mounting bracket 160. A plurality of vertically oriented tubes or guide rods 162 have their lower ends fixedly connected to the mounting bracket 160 and are operatively associated with a servo unit 164 which is fixedly mounted upon a vertically extending housing 166. Accordingly, as the plurality of tubes or guide rods 162 move relative to the servo unit 164, the plurality of suction cups 154 will accordingly be moved upwardly and downwardly. It is to be noted at this juncture that the control of all movable components, the operation of all valving, not necessarily shown, and the like, comprising the automatic packaging dispensing system 100 are under the control of a suitable control unit which may be, for example, a programmable logic controller 168 schematically illustrated within FIG. 1, which causes the various operative components to act as described in accordance with patron order data transmitted thereto from the point-of-sale (POS) location.

Continuing further, it is also seen that the vertically oriented housing 166 is fixedly mounted upon a mounting plate 170 and that the mounting plate 170 is fixedly connected to a servo unit 172 which, in turn, is slidably movable upon a linear slide 174. Accordingly, when the servo unit 172 moves along the linear slide 174, it will cause the suction cup assembly, comprising the mounting plate 170, the housing 166, the tubes 162 and the servo unit 164, and the mounting bracket 160, the vacuum generators 158, the vacuum manifolds 156, and the vacuum suction cups 154 to move laterally toward the left or right as viewed within FIGS. 6 and 7, or to move into or out of the page as viewed within FIG. 1. In a similar manner, the servo unit 164 can effectively cause the tubes or guide rods 162 to move upwardly and downwardly so as to, in turn, cause the mounting bracket 160, the vacuum generators 158, the vacuum manifolds 156, and the vacuum suction cups 154 to move upwardly and downwardly. Accordingly, when these compound movements are properly controlled and timed by means of, for example, the programmable logic controller (PLC) 168, the vacuum pickup and transfer assembly 120 can be moved to a position whereby the plurality of vacuum suction cups 154 will be disposed above a selected one of the plurality of packaging box assemblies 106 which has been moved into position beneath the vacuum suction cups 154 of the vacuum pickup and transfer assembly 120 by means of the linear belt drive 110, the vacuum control generators 158 can then be actuated, and then the servo unit 164 can be actuated so as to move the vacuum suction cups 154 downwardly such that the vacuum suction cups 154 can remove or extract the uppermost one of the packaging boxes 122 from the selected one of the plurality of packaging box assemblies 106. The servo unit 164 can then be actuated so as to elevate the packaging box 122 that has been removed or extracted from the selected packaging box assembly 106, the servo unit 172 can then be actuated so as to effectively retract the vacuum suction cup assembly from its forward-most position above the selected one of the plurality of packaging box assemblies 106 to a predetermined rearward-most position at which the vacuum suction cups 154 will now be disposed above the food preparation line conveyor 124. The servo unit 164 can then be actuated again so as to lower the vacuum suction cups 154 toward the food preparation line conveyor 124, and when the vacuum suction cups 154 are disposed immediately above the food preparation line conveyor 124, the vacuum generators 158 can be deactivated whereby the packaging box 122 will be released from the vacuum suction cups 154 and deposited onto the food preparation line conveyor 124.

With reference now being made to FIGS. 8-12, the wrapping paper packaging sub-system 104 will now be described. More particularly, it is seen that the wrapping paper packaging sub-system 104 comprises a wrapping paper packaging housing 176 within which there is disposed a plurality of horizontally oriented, vertically spaced trays 178, each one of the trays 178 holding a predetermined number of wrapping paper packaging sheets, and wherein each tray 178 holds a different type or size of wrapping paper packaging sheet. An L-shaped angle iron or angle bracket 182 has its long leg fixedly secured to the rear wall 183 of the housing 176 while the short leg of the L-shaped angle iron or angle bracket 182 is fixedly secured to a slide block 180 which is part of a vertically oriented linear ballscrew actuator 184 which is driven by means of a suitable motor 186, all of which can best be seen in FIG. 9. In addition, it is seen that the vertically oriented ball screw actuator 184 is also fixedly mounted upon a vertically oriented mounting platform or wall 188 which is also shown transparently within FIG. 10 for clarity purposes.

As can best be seen in FIG. 11, the rear wall 183 of the housing 176 is integrally connected to a left wall 190 of the housing 176 from which project a pair of vertically oriented, laterally spaced female track members 192 which are adapted to engage and slide along a pair of vertically oriented, laterally spaced male guide rails 194. In this manner, as the wrapping paper packaging housing 176 is moved vertically upwardly and downwardly by means of the linear ballscrew actuator 184, the movement and support of the wrapping paper packaging housing 176 is provided by means of the operatively cooperative track members 192 and guide rails 194. It is lastly noted, as can also best be seen in FIGS. 10 and 11, that a vertically oriented rail 193 is mounted upon the left wall 190 of the housing 176, while a pair of pneumatic brake components 195,195 are mounted upon the mounting platform or wall 188 so as to be disposed upon opposite sides of the vertically oriented rail 193. These pneumatic brake components 195,195 are provided, and are adapted to be moved toward each other so as to fixedly grasp opposite sides of the vertically oriented rail 193, so as to prevent the entire wrapping paper packaging housing 176 from falling, for example, power to the motor 186 and the linear ballscrew actuator 184 should be terminated for some reason, such as, for example, a power switch or circuit breaker has been tripped, or the like.

With reference still being made to FIG. 11, it is further seen that each tray 178 is also slidable upon horizontally oriented ball-bearing slides or tracks 196 which extend from the rear wall 183 of the housing 176 toward the front of the housing 176, which is open so as to permit the front edge portions of the plurality of trays 178 to project outwardly therefrom, so that the trays 178 can be easily and readily moved from their normal positions disposed internally within the tray housing 176 to external positions relative to the tray housing 176 when packaging sheets within a particular one of the trays 178 need to be accessed by means of the vacuum suction cups 154 of the vacuum pickup and transfer assembly 120. Each forward end of each wrapping paper tray 178 is provided with a horizontally oriented finger 198, and a horizontally oriented tray extension piston-cylinder assembly 200 is mounted upon the external surface of the vertically oriented mounting platform or wall 188 such that when the piston of the piston-cylinder assembly 200 is extended, the piston will encounter the finger 198 of a particular wrapping paper tray 178 and thereby cause that particular tray 178 to be moved out from the interior of the paper tray housing 176 to an external position at which the vacuum suction cups 154 of the vacuum pickup and transfer assembly 120 can engage the uppermost wrapping paper sheet within that particular wrapping paper tray 178 and then transfer that wrapping paper sheet to the food preparation line conveyor 124.

More particularly, it is to be noted that the distal end of the piston of the piston-cylinder assembly 200 is provided with a head portion 202 which has a slotted section 204, which can be seen in FIG. 11, through which the various fingers 198 of the various paper trays 178 can pass as the paper tray housing 176 is moved upwardly or downwardly, however, when the paper tray housing 176 has been moved upwardly or downwardly such that a particular one of the paper trays 178 is located at the correct position for that particular tray 178 to be moved out from the housing 176 such that the wrapping paper packaging sheets disposed within that tray 176 can be accessed, the finger 198 of that particular paper tray 178 will be disposed within the slotted section 204 defined within the head portion 202 of the piston of the piston-cylinder assembly 200 such that when the piston-cylinder assembly 200 is actuated, the head portion 202 of the piston of the piston-cylinder assembly 200 can act upon the finger 198 of that particular paper tray 178 so as to move that particular paper tray 178 outwardly from the paper tray housing 176 whereby the uppermost wrapping paper packaging sheet disposed within that extended tray 178 can now be grasped by means of the vacuum suction cups 154 of the vacuum pickup and transfer assembly 120.

With reference again being made to FIG. 1, a wrapping paper packaging sheet sensor 206 is mounted at a location upon the food preparation line 126 that is adjacent to and disposed above the wrapping paper packaging housing 176 such that when a selected paper tray 178 of the wrapping paper packaging housing 176 is extended outwardly from the wrapping paper packaging housing 176 such that the uppermost wrapping paper packaging sheet disposed within the selected paper tray 178 can in fact be grasped by means of the vacuum suction cups 154 of the vacuum pickup and transfer assembly 120 and transferred to the food preparation line conveyor 124, the wrapping paper packaging sheet sensor 206 can determine the vertical distance to the uppermost wrapping paper packaging sheet disposed within the selected paper tray 178. It is to be appreciated that this distance will vary as the supply of wrapping paper disposed within a particular paper tray 178 is steadily depleted. Accordingly, the sensor 206 will transmit a signal to the vacuum pickup and transfer assembly 120 such that, for example, the tubes and servo system 162,164 will know precisely how far to move the plurality of suction cups 154 downwardly in order to properly engage and extract the uppermost wrapping paper sheet disposed within the extended paper tray 178.

Lastly, as can best be appreciated from FIGS. 11 and 12, each paper tray 178 is seen to have a substantially rectangular configuration so as to house or accommodate the various different wrapping paper packaging sheets. Accordingly, in order to permit any one paper tray 178 to house or accommodate any particularly sized wrapping paper packaging sheet, a pair of adjustable guides 208,210 are respectively slidably mounted within a pair of guide slots 212,214, all located upon two sides of each paper tray 178 which form a corner section 216 of the paper tray 178. Set screws 218,220, or the like, are mounted within the adjustable guides 208,210 so as to fix the adjustable guides 208,210 at desired positions according to the particularly sized wrapping paper packaging sheets to be accommodated or housed the particular paper tray 178. Such guides 208,210, guide slots 212,214, and set screws 218,220 are similar to those components conventionally utilized within photocopying machines for accommodating or housing differently sized photocopy paper sheets such as, for example, letter sized paper or A4 international sized paper. Still yet further, each paper tray 178 is provided with a through-hole 222 to permit, for example, a light beam or other sensor signal to pass therethrough so as to indicate that the supply of wrapper paper packaging sheets, disposed within the tray 178, has been depleted, such a sensing system again being similar in operation to a paper supply sensor system incorporated within a photocopying machine.

Obviously, many variations and modifications of the present invention are possible in light of the above teachings. For example, in lieu of, or in conjunction with, the Point-of-Sale (POS) location, the overall system 100 can also include a user interface where patrons can enter their orders whereupon the rest of the system 100, as controlled by means of the programmable logic controller (PLC) 168, will automatically dispense the properly required food item packaging. Still further, a brake can be operatively associated with the box support platform 130 so as to ensure that the support platform 130 is fixedly held against the vertically oriented guide rail 146 at a predeterminedly elevated position, the brake being released when the constant force springs 134 are to move the platform 130 upwardly toward the suction cups 154. The brake effectively works in combination with vacuum sensors which will effectively confirm that sufficient vacuum is being provided to the suction cups 154 and that the platform 130 is to be maintained at its predetermined elevation so as to enable the suction cups 154 to remove the uppermost packaging box 122. It is therefore to be understood that within the scope of the appended claims, the present invention may be practiced otherwise than as specifically described herein.

REFERENCE NUMBER KEY

100—Automatic packaging dispensing system
102—Packaging box sub-system
104—Wrapping paper packaging sub-system
106—Packaging box assemblies
108—Mounting plate
110—Linear belt drive
112—Mounting bracket
114—Linear slide block
116—Reversible motor
118—Horizontally oriented guide rail
120—Vacuum suction cup pickup and transfer assembly

122—Exemplary packaging box
124—Food preparation line conveyor
126—Food preparation line
128—Box support platform
130—Horizontally oriented component of 128
132—Upstanding bracket 132 of 128
134—Constant force springs
136—Horizontal spindle
138—End brackets
140—Peripheral framework
141—Upper end portions of guide rods 144
142—Leaf-spring fingers
143—Slots defined within peripheral framework 140
144—Vertically oriented packaging box guide rods
145—Mounting plates securing ends 141 of guide rods 144 within slots 143
146—Corner regions of packaging box 122
148—Mounting bracket
152—Packaging box sensor
154—Suction cups
156—Vacuum manifolds
158—Vacuum generators
160—Mounting bracket
162—Vertically oriented guide rods
164—Servo unit
166—Housing
168—Programmable logic controller (PLC)
170—Mounting plate
172—Servo unit
174—Linear slide
176—Wrapping paper packaging housing
178—Trays of housing 176
180—Slide block on linear ball screw actuator 184
182—Angle bracket
183—Rear wall of housing 176
184—Linear ballscrew actuator
186—Motor drive for actuator 184
188—Mounting platform 188
190—Left wall of housing 176
192—Track members
193—Vertically oriented rail
194—Guide rails for track members 192
195—Pneumatic brake components
196—Ball bearing slide tracks for trays 178
198—Finger on forward end of each tray 178
200—Piston-cylinder assembly
202—Head portion of piston-cylinder assembly 200
204—Slotted section of head portion 202
206—Wrapping paper packaging sheet sensor
208,210—Adjustable guides in each tray 178
212,214—Slots for guides 208,210
216—Corner section of tray 178
218,220—Set screws for guides 208,210
222—Through hole within tray 178 for detecting depletion of wrapping sheets

What is claimed as new and desired to be protected by Letters Patent, is:

1. An automatic packaging dispensing system for automatically dispensing packaging, disposed at a pickup location, to a downstream location, the system comprising:

a plurality of packaging materials, within which items can be packaged, disposed within at least one vertically stacked array at said pickup location;

a pickup device, disposed at said pickup location, for picking up an uppermost one of said plurality of packaging materials, wherein said pickup device is operatively mounted upon at least one vertically oriented guide rod which is operatively associated with a first motor drive for moving said pickup device along with said at least one vertically oriented guide rod such that said pickup device can move vertically upwardly and downwardly, and wherein said at least one vertically oriented guide rod and said first motor drive are operatively mounted upon a horizontally oriented slide mechanism which is operatively associated with a second motor drive for moving said at least one vertically oriented guide rod, said first motor drive, and said pickup device along said horizontally oriented slide mechanism such that said pickup device can move horizontally forwardly and backwardly; and a control system for: moving said plurality of packaging materials toward said pickup location such that said uppermost one of said plurality of packaging materials, disposed within said at least one vertically stacked array, is disposed at said pickup location; moving said pickup device downwardly along with said at least one vertically oriented guide rod and into a position to pick up said uppermost one of said plurality of packaging materials disposed within said at least one vertically stacked array; moving said pickup device upwardly along with said at least one vertically oriented guide rod so as to remove said uppermost one of said plurality of packaging materials from remaining ones of said plurality of packaging materials disposed within said at least one vertically stacked array; and moving said pickup device, said at least one vertically oriented guide rod, and said first motor drive horizontally away from said pickup location, and along said horizontally oriented slide mechanism, so as to transfer said uppermost one of said plurality of packaging materials from said pickup location toward the downstream location.

2. The system as set forth in claim 1, wherein:

said plurality of packaging materials comprises a plurality of packaging boxes.

3. The system as set forth in claim 2, wherein:

said plurality of packaging boxes are different and are disposed within different vertically stacked arrays of said at least one vertically stacked array.

4. The system as set forth in claim 3, wherein:

said vertically stacked arrays of packaging boxes are disposed upon different packaging box support platforms.

5. The system as set forth in claim 4, wherein:

each one of said different packaging box support platforms is provided with a through-hole for permitting a sensor signal to pass therethrough and thereby detect when a supply of packaging boxes disposed upon a particular one of said different packaging box support platforms has been depleted.

6. The system as set forth in claim 5, wherein:

each one of said packaging box support platforms has a pair of laterally spaced, vertically oriented guide rods operatively associated with said packaging box support platform for maintaining the respective vertically stacked array of packaging boxes upon said packaging box support platform.

7. The system as set forth in claim 6, wherein:

said pair of laterally spaced, vertically oriented guide rods are laterally adjustable with respect to said packaging box support platform so as to accommodate differently sized packaging boxes.

8. The system as set forth in claim 4, wherein:

at least one constant force spring is operatively connected to each one of said packaging box support platforms so as to constantly bias each one of said packaging box support platforms in an upward direction such that an uppermost one of said plurality of packaging boxes is always disposed at a position which will enable said uppermost one of said plurality of packaging boxes to be picked up by said pickup device.

9. The system as set forth in claim 2, wherein:

said pickup device comprises at least one vacuum suction cup for picking up one of said packaging boxes.

10. The system as set forth in claim 1, wherein:

said plurality of packaging materials comprises a plurality of wrapping paper packaging sheets.

11. The system as set forth in claim 10, wherein:

said plurality of wrapping paper packaging sheets are disposed within a plurality of wrapping paper packaging sheet trays.

12. The system as set forth in claim 11, wherein:

said plurality of wrapping paper packaging sheet trays are disposed within a housing;

a first actuator mounted at a predetermined location upon said housing for operatively engaging a selected one of said plurality of wrapping paper packaging sheet trays so as to move said selected one of said plurality of wrapping paper packaging sheet trays out from said housing such that said wrapping paper packaging sheets disposed within said selected one of said plurality of wrapping paper packaging sheet trays is available to be picked up by said pickup device; and a second actuator mounted upon said housing for moving said plurality of wrapping paper packaging sheet trays toward said predetermined location at which said first actuator is located such that said selected one of said plurality of wrapping paper packaging sheet trays will be disposed at a position at which said first actuator can move said selected one of said plurality of wrapping paper packaging sheet trays out from said housing.

13. The system as set forth in claim 12, wherein:

said first actuator comprises a horizontally oriented piston-cylinder assembly; and said second actuator comprises a vertically oriented linear ball screw actuator.

14. The system as set forth in claim 11, wherein:

each one of said plurality of trays is provided with adjustable guides such that each one of said plurality of trays can accommodate differently sized wrapping paper packaging sheets.

15. The system as set forth in claim 11, wherein:

each one of said plurality of trays is provided with a through-hole for permitting a sensor signal to pass therethrough and thereby detect when a supply of wrapping paper packaging sheets disposed within said tray has been depleted.

16. The system as set forth in claim 10, wherein:

said pickup device comprises at least one vacuum suction cup for picking up at least one of said wrapping paper packaging sheets.

17. An automatic packaging dispensing system for automatically dispensing packaging, disposed at a pickup location, to be moved to a downstream location, the system comprising:

a first set of packaging materials within which a first type of item can be packaged, said first set of packaging materials being disposed within a first vertically stacked array;

a second set of packaging materials, different from said first set of packaging materials, within which a second type of item can be packaged, said second set of packaging materials being disposed within a second vertically stacked array;

a pickup device, disposed at said pickup location, for picking up an uppermost one of said first set of packaging materials disposed within said first vertically stacked array or an uppermost one of said second set of packaging materials disposed within said second vertically stacked array, wherein said pickup device is operatively mounted upon at least one vertically oriented guide rod which is operatively associated with a first motor drive for moving said pickup device along with said at least one vertically oriented guide rod such that said pickup device can move vertically upwardly and downwardly, and wherein said at least one vertically oriented guide rod and said first motor drive are operatively mounted upon a horizontally oriented slide mechanism which is operatively associated with a second motor drive for moving said at least one vertically oriented guide rod, said first motor drive, and said pickup device along said horizontally oriented slide mechanism such that said pickup device can move horizontally forwardly and backwardly; and a control system for: moving said first set of packaging materials or said second set of packaging materials toward said pickup location such that said uppermost one of said first set of packaging materials or said uppermost one of said second set of packaging materials, disposed within said first or second vertically stacked array, is disposed at said pickup location; moving said pickup device downwardly along with said at least one vertically oriented guide rod and into a position to pick up said uppermost one of said first or second set of packaging materials disposed within said first or second vertically stacked array; moving said pickup device upwardly along with said at least one vertically oriented guide rod so as to remove said uppermost one of said first or second set of packaging materials, disposed within said first or second vertically stacked array, from remaining ones of said first or second set of packaging materials disposed within said first or second vertically stacked array; and moving said pickup device, said at least one vertically oriented guide rod, and said first motor drive horizontally away from said pickup location, and along said horizontally oriented slide mechanism, so as to transfer said uppermost one of said first or second set of packaging materials from said pickup location toward the downstream location.

18. The system as set forth in claim 17, wherein:

said first set of packaging materials comprises a set of packaging boxes; and said second set of packaging materials comprises a set of wrapping paper packaging sheets.

19. The system as set forth in claim 17, wherein:

said pickup device comprises at least one suction cup which can selectively pick up a selected one of said first set of packaging materials or can selectively pick up a selected one of said second set of packaging materials.

* * * * *